US007115350B2

(12) United States Patent
Jung

(10) Patent No.: US 7,115,350 B2
(45) Date of Patent: Oct. 3, 2006

(54) LOW TEMPERATURE FIXING TONER

(75) Inventor: Hee-won Jung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 175 days.

(21) Appl. No.: 10/785,402

(22) Filed: Feb. 25, 2004

(65) Prior Publication Data

US 2004/0229146 A1 Nov. 18, 2004

(30) Foreign Application Priority Data

Feb. 26, 2003 (KR) ..... 10-2003-0011953

(51) Int. Cl.
*G03G 9/087* (2006.01)

(52) U.S. Cl. ..... 430/109.2; 430/109.3; 430/109.4

(58) Field of Classification Search ..... 430/109.2, 430/109.3, 109.4
See application file for complete search history.

(56) References Cited

U.S. PATENT DOCUMENTS 5,795,691 A * 8/1998 Yamazaki et al. ..... 430/111.35
6,136,488 A * 10/2000 Kushino et al. ..... 430/108.21
6,194,115 B1 * 2/2001 Nagase et al. ..... 430/109.4
6,350,822 B1 * 2/2002 Van Diepen et al. ..... 525/444
6,723,822 B1 * 4/2004 Shirai et al. ..... 528/195

FOREIGN PATENT DOCUMENTS

| | | |
|---|---|---|
| EP | 0 148 476 | 7/1985 |
| JP | 60-134248 | 7/1985 |

* cited by examiner

*Primary Examiner*—John L Goodrow
(74) *Attorney, Agent, or Firm*—Staas & Halsey LLP

(57) ABSTRACT

A toner includes a binder resin, a charge control agent, and a pigment. The binder resin includes a main binder resin and 10 to 100 parts by weight of crystalline polyester that maintains a polymer chain orientation even in a molten state, based on the main binder resin. Therefore, the toner may be fixed at a low temperature, while maintaining long-term storage stability and durability. As a result, the aging of a fixing apparatus, the curling of sheets of paper, and excess energy consumption may be overcome. Furthermore, since separate equipment and a structural change of a fixing apparatus are not required, an existing printer model may be used. Since the time required for fixing is short, high-speed printing is facilitated.

7 Claims, 3 Drawing Sheets

LOW TEMPERATURE FIXING TONER

CROSS-REFERENCE TO RELATED APPLICATIONS

This application claims the priority of Korean Patent Application No. 2003-11953, filed on Feb. 26, 2003, in the Korean Intellectual Property Office, the disclosure of which is incorporated herein by reference in its entirety.

BACKGROUND OF THE INVENTION

1. Field of the Invention

The present invention relates to a toner, and more particularly, to a toner that may be fixed at low temperature by adding a crystalline polyester resin to a main binder resin.

2. Description of the Related Art

An inkjet printer and a laser printer have been currently widely used. The inkjet printer is typically used as a personal printer due to a slow print speed. On the other hand, the laser printer is suitable to be used in an office environment in which it is linked to several network computers to print a large volume. In such a laser printer, a latent image is created on a photoconductor (OPC) using a laser. Thereafter, a toner is attracted to the latent image of the photoconductor due to the difference of the electric potential, and then the latent image is transferred onto a receiving material, such as a sheet of paper, resulting in a visible image.

A laser printer that has been currently developed or commercially available is a black and white dry printer. In the black and white dry printer, a toner is charged by friction and then transferred to a latent image of a photoconductor due to the difference of the electric potential. Even though the black and white dry printer causes an environmental problem such as dust generation due to toner particles, the black and white dry printer has an advantage in that it may be easily manufactured in a small size at a low cost.

Generally, a dry toner includes a pigment, a charge control agent (CCA) that adjusts the amount of the charges of the toner, a binder resin that binds the pigment and the charge control agent, and a releasing agent that facilitates the separation of-a transfer medium after the transfer. Furthermore, a surface additive is added to the surfaces of toner particles to impart functionality to the toner particles or to enhance the physical properties of the toner particles.

A toner image formed on the surface of a transfer medium is finally fixed by a contact or non-contact developing method. With respect to the former, a heat roller fixing method is mainly used, in which a toner image formed on the surface of a transfer medium is fixed by a heat roller set to 120 to 180° C.

About 80 to 90% of a dry toner comprises a binder resin as described above. In such a dry toner, an offset resistance and a fixing property on a transfer medium are required. The term, "offset," as used herein, indicates a phenomenon that when a toner image transferred from the surface of a drum to the surface of a transfer medium is thermally fixed due to attachment of the toner image on a heat roller, the toner image is printed on an unwanted surface of a transfer medium during subsequent printing. The offset printing may be divided into a cold offset that occurs at a low temperature range and a hot offset that occurs at a high temperature range. The above-described properties of a toner are mainly determined by the properties of a binder resin used in preparation of the toner. Generally, if the melting temperature of a binder resin is low, a fixing property is effective, but an offset resistance is ineffective. On the other hand, if the melting temperature of a binder resin is high, an offset resistance is effective but a fixing property is ineffective.

Since a binder resin with a low melting temperature also has a low glass transition temperature (Tg) (also called a softening point), repeated developing by a heat roller fixing method may cause deterioration/aggravation and ineffective storage stability of a toner due to a mechanical friction force. To prevent these problems, use of a binder resin with a high glass transition temperature may be considered. However, in this case, due to the low thermal efficiency of the binder resin, a toner image is incompletely fixed and a high fixing temperature is required. For this reason, an intense heat is used for fixing, which may cause aging of a fixing apparatus. Furthermore, an intense heat may cause paper curling, excess energy consumption, and insufficient pulverizability, thus decreasing production efficiency. For example, with respect to a styrene based copolymer resin generally used as a binder resin for a toner, a fixing temperature varies, depending on the composition of the binder resin, the outer diameter of a heat roller, and a print speed. However, in a general case, since a fixing temperature may be as high as about 160° C., an intense heat is used during fixing, which may cause the above-described problems.

Meanwhile, in an attempt to enhance an offset resistance, a method was implemented in which the surface of a heat roller was coated with fluorinated resin or silicon oil. However, this method increased the size, structural complexity, and manufacturing cost of a fixing apparatus. Even though an offset resistance was enhanced, the fixing temperature of a binder resin was still high.

In this regard, attempts have been made to decrease the fixing temperature of a toner simultaneously with satisfying a fixing property and an offset resistance.

Japanese Patent Laid-Open Publication No. Sho. 60-134, 248 discloses a partially crosslinked binder resin, one particle of which has a crosslinked structure and a low molecular weight linear structure obtained through a two step polymerization. However, the offset resistance and the fixing property of a toner tend to be inversely related according to the crosslinking density of the binder resin. That is, a low crosslinking density ensures an effective fixing property. However, it is difficult to maintain an appropriate gel content, which may lower an offset resistance. On the other hand, a high crosslinking density ensures an effective offset resistance, but lowers a fixing property. Also, there arises a problem in that such a crosslinking density is not easily adjusted.

Meanwhile, as an attempt to enhance both the offset resistance and the low temperature fixing property, a study has been done on development of a capsule toner having an inner core and an outer shell that are different in terms of a material and a structure. In this regard, according to a known technique that ensures low temperature fixing simultaneously with satisfying a long-term storage stability, a liquid or a low melting point wax that may be easily plasticized is used as the inner core of the capsule toner and a strong material is used as the outer shell of the capsule toner. However, such a capsule toner has an ineffective fixing property. To overcome this problem, use of a liquid core can be considered. In this case, however, if the strength of the shell is weak, a toner is broken down in a developing apparatus, thus causing internal contamination. In this regard, a high melting point polymer may be used as a shell material. However, the high melting point polymer cannot be used for low temperature fixing. In addition, the capsule toner involves a complicated preparation process and requires a separate additional apparatus, thus incurring an additional cost.

There is another method of using common polyester as a binder resin. However, polyester commonly used as a toner binder has a glass transition temperature of about 61° C. and a melting temperature of about 160° C., which are insufficient to lower a fixing temperature. Therefore, using common polyester is not suitable for low temperature fixing.

SUMMARY OF THE INVENTION

Embodiments of the present invention provide a toner that may be fixed at a low temperature while maintaining long-term storage stability and durability, by decreasing the melting temperature of a styrene based binder resin with no change in the glass transition temperature.

According to an aspect of the present invention, a toner comprises: a binder resin comprising a main binder resin and 10 to 100 parts by weight of crystalline polyester, based on 100 parts by weight of the main binder resin, the crystalline polyester comprising diol represented by Formula 1 below:

Formula 1

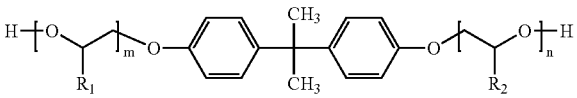

wherein, $R_1$ and $R_2$ are hydrogen or methyl, and n and m are 1 or 2;

2 to 25 moles of carboxylic anhydride represented by Formula 2 below, based on 100 moles of the diol of Formula 1:

Formula 2

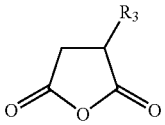

wherein, $R_3$ is an alkyl group of $C_{1-12}$;

20 to 50 moles of terephthalic acid, based on 100 moles of the diol of Formula 1; and 2 to 15 moles of trimellitic anhydride represented by Formula 3 below, based on 100 moles of the diol of Formula 1:

Formula 3

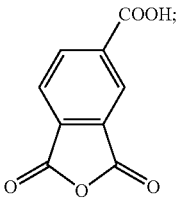

a charge control agent; and a pigment.

The crystalline polyester may maintain a polymer chain orientation in a molten state.

The crystalline polyester may have a weight average molecular weight of 10,000 to 100,000.

The crystalline polyester may have a melting temperature of approximately 100 to 120° C. and the glass transition temperature of the crystalline polyester may not be observed in a differential scanning calorimetry (DSC) analysis.

The main binder resin may be styrenes, acrylics, ethers, esters, epoxies, or copolymers thereof.

The main binder resin may have a glass transition temperature of approximately 40 to 70° C. and a weight average molecular weight of 10,000 to 1,000,000.

The main binder resin and the crystalline polyester may be blended or form a copolymer.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
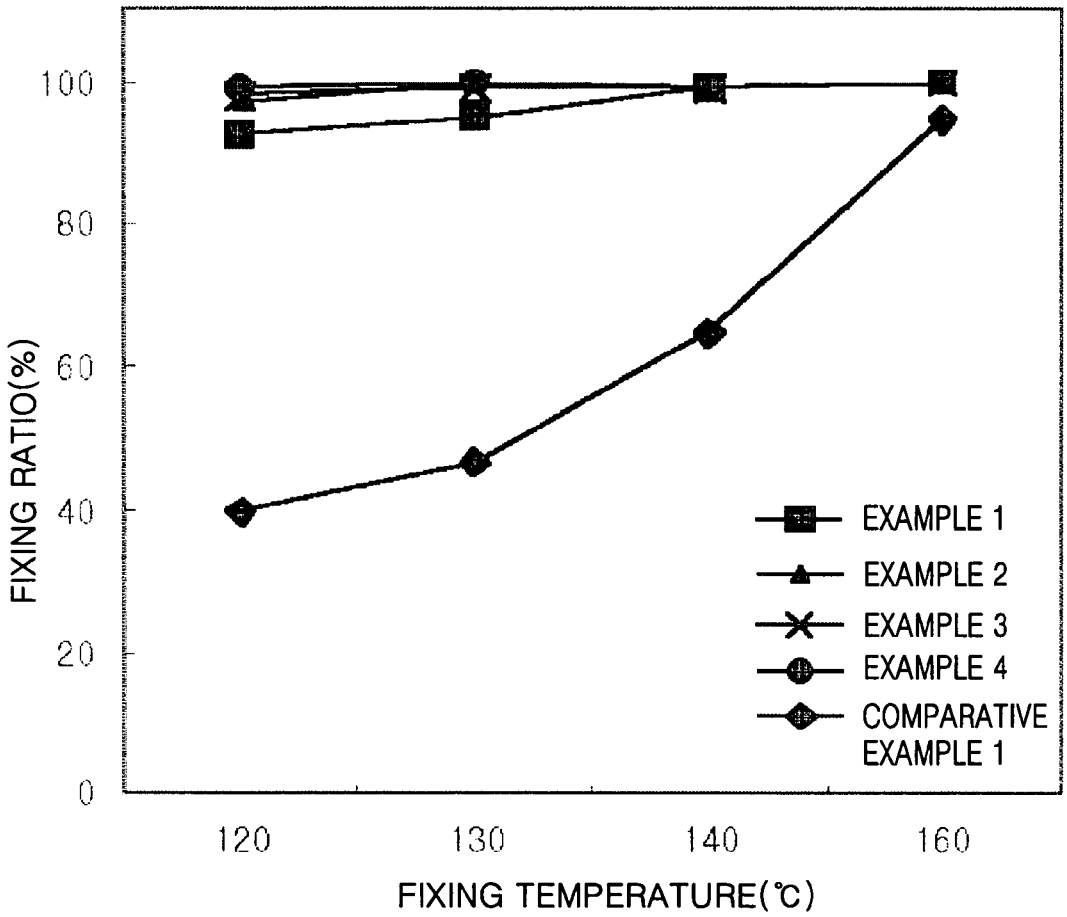
FIG. 1 shows fixing characteristics of toners according to Examples 1 through 4 of the present invention and Comparative Example 1 on 75 g/cm$^2$ weight papers.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, embodiments of the present invention will be described in more detail.

The present invention provides a toner that satisfies both an offset resistance and a fixing property by enlarging an optimal fixing temperature range. Here, the optimal fixing temperature range extends from the lowest fixing temperature to a temperature just prior to reaching a temperature at which a hot offset occurs. In this regard, an optimal fixing temperature range may be enlarged by lowering the lowest fixing temperature and raising the temperature at which a hot offset occurs.

Generally, dry toners are available in the form of a two-component developer comprised of a non-magnetic toner and a magnetic carrier and a one-component developer consisting of a toner. Among them, the one-component developer can ensure the miniaturization, low cost, and easy maintenance and repair of printers. Such a one-component developer may be divided into a magnetic toner and a non-magnetic toner according to a transfer mechanism of charged toner particles to a latent image. In the magnetic toner, toner particles exhibit a magnetic property by addition of ferrite or the like, and thus, are transferred to a latent image by a magnetic force. On the other hand, in the non-magnetic toner, toner particles are transferred to a latent image by the flowability of the toner particles. Since a magnetic material is not used in the non-magnetic toner, a toner cost is low and color printing is possible. Therefore, a non-magnetic, one-component developer has been widely used for printers, thus remarkably increasing a print speed.

The toner of an embodiment of the present invention may be a magnetic, one-component dry toner, a non-magnetic, one-component dry toner, or a two-component dry developer.

The toner of an embodiment of the present invention includes a binder resin, a charge control agent, and a pigment. The binder resin includes a main binder resin and 10 to 100 parts by weight of crystalline polyester, based on 100 parts by weight of the main binder resin. The crystalline polyester includes diol represented by Formula 1 below:

Formula 1

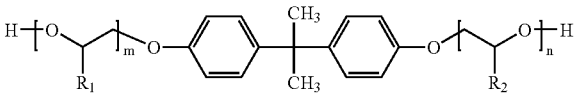

wherein, $R_1$ and $R_2$ are hydrogen or methyl, and n and m are 1 or 2;

2 to 25 moles of carboxylic anhydride represented by Formula 2 below, based on 100 moles of the diol of Formula 1:

Formula 2

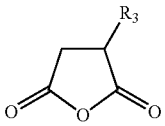

wherein, $R_3$ is an alkyl group of $C_{1-12}$;

20 to 50 moles of terephthalic acid, based on 100 moles of the diol of Formula 1; and 2 to 15 moles of trimellitic anhydride represented by Formula 3 below, based on 100 moles of the diol of Formula 1:

Formula 3

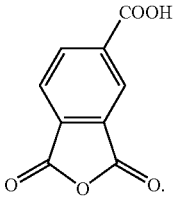

In Formula 1, n and m may be 1 or 2. If the value of n and m exceeds 2,the ratio of an aliphatic chain on the polymer chain of the crystalline polyester increases, thus adversely affecting a unidirectional orientation of the polymer chain in a molten state.

Meanwhile, the carboxylic anhydride of Formula 2 may be used in an amount of 2 to 25 moles, based on 100 moles of the diol of Formula 1, to enhance the pulverizability of the crystalline polyester. If the content of the carboxylic anhydride of Formula 2 is less than 2 moles, the crystalline polyester becomes excessively rigid, thus decreasing pulverizability. On the other hand, if the content of the carboxylic anhydride of Formula 2 exceeds 25 moles, the ratio of an aliphatic chain excessively increases, thus adversely affecting a unidirectional orientation of the polymer chain in a molten state. In Formula 2, $R_3$ is an alkyl group of $C_{1-12}$. If the number of carbons in the alkyl group exceeds 12, a unidirectional polymer chain orientation cannot be accomplished.

The terephthalic acid may be used in an amount of 20 to 50 moles, based on 100 moles of the diol. If the content of the terephthalic acid is less than 20 moles, it is difficult to prepare the crystalline polyester with an appropriate weight average molecular weight. In addition, the crystalline polyester may not exhibit a unidirectional orientation in a molten state. On the other hand, if the content of the terephthalic acid exceeds 50 moles, pulverizability decreases.

The trimellitic anhydride may be used in an amount of 2 to 15 moles, based on 100 moles of the diol, to allow for the partial crosslinkage of the crystalline polyester of an embodiment of the present invention. Therefore, the molecular weight of the crystalline polyester may be increased above a predetermined level. If the content of the tricarboxylic anhydride exceeds 15 moles, due to excess crosslinkage, a unidirectional orientation of the polymer chain in a molten state may not be accomplished.

The crystalline polyester, as used herein, is a polyester resin produced by copolymerization of diol that is a derivative of bisphenol A, terephthalic acid, and aromatic tricarboxylic acid, as main components. Therefore, aromatic rings occupy a largest portion of the polymer structure of the crystalline polyester. Unlike a common noncrystalline polyester resin, the polymer chain of the crystalline polyester has a relatively low crosslinkage ratio and is of a wholly linear structure, thus accomplishing a unidirectional polymer chain orientation. Therefore, orientation of the crystalline polyester is maintained even in a molten state, in a similar fashion to the orientation of a liquid crystal polymer.

The crystalline polyester may be blended or copolymerized with the main binder resin. Preferably, the crystalline polyester is used in an amount of 10 to 100 parts by weight, based on 100 parts by weight of the main binder resin. If the content of the crystalline polyester is less than 10 parts by weight, the addition effect of the crystalline polyester is insufficient. On the other hand, if the content of the crystalline polyester exceeds 50 parts by weight, the brittleness of the crystalline polyester becomes ineffective, which is not preferable in preparation of a toner.

Meanwhile, the crystalline polyester may have a weight average molecular weight of 10,000 to 100,000. If the weight average molecular weight is less than 10, 000, the crystalline polyester may undergo phase transitions such as evaporation or liquefaction during a long-term storage. On the other hand, if the weight average molecular weight exceeds 100, 000, pulverizability is remarkably lowered, thus decreasing toner production efficiency. In addition, an excess fixing energy is required, and the time required for preheating a fixing apparatus is increased, thus decreasing an initial print speed and lowering the quality.

The crystalline polyester may have a melting temperature of 100 to 120° C. In a differential scanning calorimetry (DSC) analysis, while a peak corresponding to the melting temperature is observed, a peak corresponding to the glass transition temperature is not detected. Therefore, the crystalline polyester of an embodiment of the present invention exhibits only melting temperature characteristics without exhibiting glass transition temperature characteristics. In this regard, the addition of the crystalline polyester to another resin may decrease the melting temperature of the latter resin. That is, when the crystalline polyester with a low melting temperature is added to a high melting temperature resin, such as a polystyrene resin or a polystyrene-butylmethacrylate copolymer resin, due to a relatively low melting temperature of the crystalline polyester, the melting temperature of the high melting temperature resin may be decreased, which enables low temperature fixing. Furthermore, since the crystalline polyester does not exhibit a glass transition temperature, the glass transition temperature of a main resin, for example, a polystyrene resin, is relatively unchanged. Therefore, durability and long-term storage stability of a toner are maintained. In detail, a common polystyrene-butylmethacrylate copolymer resin used as a binder resin exhibits a glass transition temperature of about 56° C. Therefore, long-term storage stability and durability are superior. However, it exhibits a melting temperature of about 160° C., thus requiring excess heat for fixing. Therefore, a fixing efficiency is rapidly decreased at less than 155° C. On the contrary, the crystalline polyester of an embodiment of the present invention directly exhibits a melting temperature without exhibiting a glass transition temperature in a DSC measurement. Since the melting temperature of the crystalline polyester is in a range of approximately 100 to 120° C., the addition of the crystalline polyester to the above binder resin may lower the entire melting temperature with no change in the glass transition temperature. Therefore, low temperature fixing may be accomplished without adversely affecting the durability and the long-term storage stability of a toner.

There are no particular limitations on the main binder resin as used herein, provided that it is commonly used as a binder resin for toners. However, styrenes, acrylics, ethers, esters, epoxies, blends or copolymers thereof may be used. Styrenes or styrene-acrylate copolymers are more preferable. Meanwhile, when polystyrene is used alone as the main binder resin, streaks may be generated on an image.

A styrene based monomer, as used herein, may be vinyltoluene, α-methylstyrene, chlorostyrene, or styrene. Examples of an acrylic based monomer include methyl (meth)acrylate, ethyl(meth)acrylate, propyl(meth)acrylate, butyl(meth)acrylate, octyl(meth)acrylate, cyclohexyl(meth) acrylate, lauryl(meth)acrylate, stearyl(meth)acrylate, benzyl (meth)acrylate, furfural(meth)acrylate, tetrahydrofurfuryl (meth)acrylate, hydroxyethyl(meth)acrylate, hydroxybutyl (meth)acrylate, and dimethylaminoethyl(meth)acrylate.

Generally, the main binder resin has a glass transition temperature of approximately 40 to 70° C. and a weight average molecular weight of 10, 000 to 1, 000, 000. If the glass transition temperature of the main binder resin is less than 40° C., the durability and the long-term storage stability of a toner are decreased. On the other hand, if the glass transition temperature of the main binder resin exceeds 70° C., a high fixing temperature is required. If the weight average molecular weight of the main binder resin is less than 10, 000, the upper limit of a non-offset range is lowered. Therefore, a toner becomes susceptible to variation of a fixing temperature between sheets of paper being printed and a variation of a fixing temperature for a temperature change at high temperature and at low temperature. Also, long-term storage stability is decreased, and the durability and the image quality for long-term printing are lowered. On the other hand, if the weight average molecular weight of the main binder resin exceeds 1, 000, 000, an excess heat is consumed during fixing, and thus, use of high energy is required. Also, aging of a fixing apparatus and the curling of sheets of paper are caused. In addition, in a pulverized toner, pulverizability is insufficient, thus rapidly lowering production efficiency. The crystalline polyester of an embodiment of the present invention strongly maintains the molecular orientation even in a molten state, and has strong cohesion, i.e., strong surface tension, thus enhancing a releasing property. Therefore, the crystalline polyester serves as a releasing agent at high temperature. Also, due to a low melting temperature, the crystalline polyester satisfies low temperature characteristics, thus enlarging the range between a cold offset and a hot offset.

The low temperature fixing binder resin of an embodiment of the present invention may result from a molten blending of the main binder resin and the crystalline polyester or from introduction of the crystalline polyester as a side chain into the main binder resin by graft reaction. Alternatively, after a main binder resin monomer is grown into a primary prepolymer, the crystalline polyester may be introduced into the primary prepolymer.

There are no particular limitations on a method of preparing the low temperature fixing toner of an embodiment of the present invention provided that a common toner preparation method is used. A polymerization method and, more generally, a pulverization method may be used. The detailed descriptions thereof will now be described in detail.

First, with respect to a polymerization method, additives such as a carbon black, a charge control agent, and a polymerization initiator are added to one or more binder monomers and uniformly dissolved and/or dispersed using a mixer such as a homogenizer or an ultrasonic disperser. The resultant mixture is then dispersed in a medium such as an aqueous solution and an organic solvent by a stirrer. Then, so that toner particles have desired sizes, the resultant dispersion is granulated by adjusting a stirring speed and duration, and then continuously stirred so that a particle state is maintained and precipitation of particles is prevented by the action of a stabilizer. The polymerization is carried out at a temperature of about 40° C. or more, preferably, 50 to 90° C. After increasing the polymerization temperature at a predetermined time after initiation of the polymerization, unreacted monomers and byproducts are removed through the removal of the aqueous solution or the organic solvent. Finally, toner particles thus obtained are filtered and dried to give a final toner.

With respect to a pulverization method, a main binder resin is first prepared. A charge control agent and a pigment are added to the main binder resin and then premixed. The premix is inputted into a high temperature, high pressure extruder, and the resultant molten mixture is extruded in the form of a thin sheet, followed by cryogenic pulverization. Then, the resultant particles are classified into desired sized particles. Thereafter, an organic material or an inorganic material used for enhancing flowability, frictional chargeability, and transferability is added to the surfaces of the intermediate toner particles to give a final toner.

According to the above polymerization method, uniform toner particles may be obtained. However, there are disadvantages in that polymers with various properties are produced, depending on the purity of the monomers, a preparation process is complicated, and reproducibility of a toner is lowered due to uneven dispersion of the additives. Furthermore, the unstable dispersion of the additives, such as a carbon black, and a charge control agent during the polymerization decreases the degree of the polymerization and polymerization stability, thus causing agglomeration of toner particles. When the carbon black is used excessively, due to the conductivity of the carbon black, the electrostatic chargeability on the surfaces of toner particles may decrease.

Therefore, a surface contamination such as a background on non-image portions, may be caused. Meanwhile, according to the pulverization method, even though the uniformity of toner particles is slightly decreased, the preparation cost is low, and a variation between polymerization lots is minimized, thus ensuring uniform image quality.

Selection of initial monomers is important in both the above-described toner preparation methods because the molecular weight, glass transition temperature, and melting temperature of a final binder resin are determined by the type of an initial monomer used. In the case of using a copolymer of the main binder resin and the crystalline polyester, monomers with a high glass transition temperature and monomers with a low glass transition temperature are copolymerized to adjust the glass transition temperature and the melting temperature of a final binder resin to an appropriate level. Generally, monomers with a high glass transition temperature are used at a higher ratio, relative to monomers with a low glass transition temperature.

A non-magnetic toner according to an embodiment of the present invention is suitable for a color toner. Carbon black is generally used as a black pigment. To make colors, yellow pigment, magenta pigment, and cyan pigment may be further included.

The yellow pigment may comprise condensed nitrogen compounds, isoindolinone compounds, anthraquinone compounds, azo metal complexes, or aryl imide compounds. In detail, C.I. PIGMENT YELLOW 12, 13, 14, 17, 62, 74, 83, 93, 94, 95, 109, 110, 111, 128, 129, 147, or 168 may be used.

The magenta pigment may comprise condensed nitrogen compounds, anthraquinones, quinacridone compounds, lake compounds of basic dyestuffs, naphthol compounds, benzoimidazole compounds, thioindigo compounds, or perylene compounds. In detail, C.I. PIGMENT RED 2, 3, 5, 6, 7, 23, 48:2, 48:3, 48:4, 57:1, 81:1, 144, 146, 166, 169, 177, 184, 185, 202, 206, 220, 221, or 254 may be used.

The cyan pigment may be copper phthalocyanine compounds and derivatives, anthraquinone compounds, or lake compounds of basic dyestuffs. In detail, C.I. PIGMENT BLUE 1, 7, 15, 15:1, 15:2, 15:3, 15:4, 60, 62, or 66 maybe used.

These pigments may be used alone or in combination of two or more types. A desired pigment is selected considering color, saturation, brightness, weatherability, and dispersability in a toner.

When a toner is negatively charged, the charge control agent, as used herein, may be metal-contained azo dyes or salicylic compounds. When a toner is positively charged, the charge control agent may be nigrosin dyes or quaternary ammonium salts. The charge control agent may be used in an amount of 0.5 to 5 parts by weight, based on the binder resin.

When needed, a wax with a melting temperature of approximately 60 to 160° C. may be used to enhance an offset resistance during fixing by a heat roller. Examples of the wax include CARBONA WAX, MONTANWAX, and glycerine monostearate.

In addition, an inorganic silica and an organic polymer bead which is a polarity imparting agent may be used as surface additives.

Meanwhile, when a toner of an embodiment of the present invention is a magnetic toner, a ferromagnetic powder with an average particle size of 0.1 to 2 μm, such as magnesite and ferrite, may be used as a magnetic material.

Hereinafter, the present invention will be described more specifically by examples. However, the following examples are provided only for illustrations, and thus, the present invention is not limited to or by the examples.

EXAMPLE 1

100 parts by weight of polystyrene with a weight average molecular weight of 30, 000, 100 parts by weight of crystalline polyester (TUFTONE C-PEs #188, KAO CO., Japan) with a weight average molecular weight of 30,000 , based on the polystyrene, 5 parts by weight of CARBON BLACK (DEGUSSA, Germany), and 2 parts by weight of a charge control agent (BONTRON S-54, ORIENT CHEMICAL INDUSTRIES, LTD.) were premixed in a HENSCHEL type mixer. The resultant mixture was inputted into a twin-screw extruder and then extruded at 130° C, followed by cryogenic solidification. The resultant product was pulverized by a jet mill, and then classified with a wind classifier to give toner particles with an average particle size of about 8 μm.

EXAMPLE 2

A low temperature fixing toner was prepared in the same manner as in Example 1 except that a blend of 180 parts by weight of a polystyrene-n-butylmethacrylate copolymer (CPR 300, MITSUI CHEMICALS, INC., Japan) (253,000 weight average molecular weight, 1:1 polymerization ratio (molar ratio of styrene monomer to butylmethacrylate monomer)) as a main binder resin and 16 parts by weight of crystalline polyester (TUFTONE C-PEs #188, KAO CO., Japan) with a weight average molecular weight of 30,000 was used as a binder resin. The obtained toner was made up of toner particles with an average particle size of about 8 μm.

EXAMPLE 3

A low temperature fixing toner was prepared in the same manner as in Example 1 except that a blend of 140 parts by weight of a polystyrene-n-butylmethacrylate copolymer (CPR 300, MITCUI CHEMICALS, INC., Japan) (253,000 weight average molecular weight, 1:1 polymerization ratio (molar ratio of styrene monomer to butylmethacrylate monomer)) as a main binder resin and 60 parts by weight of crystalline polyester (TUFTONE C-PEs #188, KAO CO., Japan) with a weight average molecular weight of 30,000 was used as a binder resin. The obtained toner was made up of toner particles with an average particle size of about 8 μm.

EXAMPLE 4

A low temperature fixing toner was prepared in the same manner as in Example 1 except that a blend of 120 parts by weight of a polystyrene-n-butylmethacrylate copolymer (CPR 300, MITSUI CHEMICALS, INC., Japan) (253,000 weight average molecular weight, 1:1 polymerization ratio (molar ratio of styrene monomer to butylmethacrylate monomer)) as a main binder resin and 80 parts by weight of crystalline polyester (TUFTONE C-PEs #188, KAC CO., Japan) with a weight average molecular weight of 30,000 was used as a binder resin. The obtained toner was made up of toner particles with an average particle size of about 8 μm.

COMPARATIVE EXAMPLE 1

A low temperature fixing toner was prepared in the same manner as in Example 1 except that 200 parts by weight of a polystyrene-n-butylmethacrylate copolymer (CPR 300, MITSUI CHEMICALS, INC., Japan) (253, 000 weight average molecular weight, 1:1polymerization ratio (molar ratio of styrene monomer to butylmethacrylate monomer)) only was used as a binder resin. The obtained toner was made up of toner particles with an average particle size of about 8 μm.

EXPERIMENTAL EXAMPLE 1

Measurements of Glass Transition Temperature and Melting Temperature

The glass transition temperatures and melting temperatures of the toners according to Examples 1 through 4 and Comparative Example 1 were measured by a DSC and the results are presented in Table 1 below. The DSC measurements were carried out at atmospheric temperature, humidity, and pressure, according to a following temperature program: heating to 200° C. at a rate of 1° C./min, quenching to −10° C. at a rate of 100° C./min, and heating at a 10° C./min. When an endothermic peak appeared due to a change in heat for a first standard cell, a temperature corresponding to the endothermic peak was read as a glass transition temperature. As seen from Table 1 below, in comparison with the toner of Comparative Example 1, the toners according to the Examples of the present invention exhibited a significantly low melting temperature with no change in the glass transition temperature. This is generally attributed to the fact that the crystalline polyester of an embodiment of the present invention exhibits a low melting temperature without exhibiting a glass transition temperature. Therefore, the entire melting temperature was lowered, while the glass transition temperature of the styrene-n-methacrylate copolymer was maintained.

TABLE 1

| | Glass Transition Temperature (Tg: ° C.) | Melting Temperature (Tm: ° C.) |
|---|---|---|
| Example 1 | 61 | 116 |
| Example 2 | 55 | 119 |
| Example 3 | 55 | 117 |
| Example 4 | 57 | 117 |
| Comparative Example 1 | 56 | 145 |

EXPERIMENTAL EXAMPLE 2

The fixing property and offset characteristics of the toners according to Examples 1 through 4 and Comparative Example 1 were determined using SAMSUNG ML-4500 printer (speed: 8PPM). The toners were developed from a developing roller to a photoconductor drum, and then transferred onto sheets of paper. The toners transferred onto sheets of paper were fixed by being passed through a fixing apparatus. The fixing apparatus comprised a heat roller and a pressure roller. The heat roller had a diameter of 18.0 mm and a nip width of 2.5 mm. The press pressure of nips was 6 kg, and a transfer speed of the sheets of paper was set to 46 mm/sec. For evaluation of a fixing property, 90 g/cm$^2$ and 75 g/cm$^2$ average weight sheets of paper that were different in weight and thickness were used. The upper limit of a fixing temperature was defined as a maximum temperature at which a hot offset does not occur, and the lower limit of a fixing temperature was defined as a temperature at which a cold offset does not occur and the fixing ratios of toners exceed 70%. The fixing ratios of the toners were evaluated by measuring a density change before and after SCOTCH TAPE stripping using a MACBETH densitometer (Model No. RD-918) and the results are shown in FIGS. 1 through 3.

FIG. 1 shows fixing properties of the toners of Examples 1 through 4 and Comparative Example 1 on 75 g/cm$^2$ weight sheets of paper. As shown in FIG. 1, in the case of Comparative Example 1, that had no crystalline polyester, a fixing property was significantly lowered at less than 140° C. On the other hand, the low temperature fixing toners of embodiments of the present invention exhibited excellent fixing property even at about 120° C.

Figure 2:
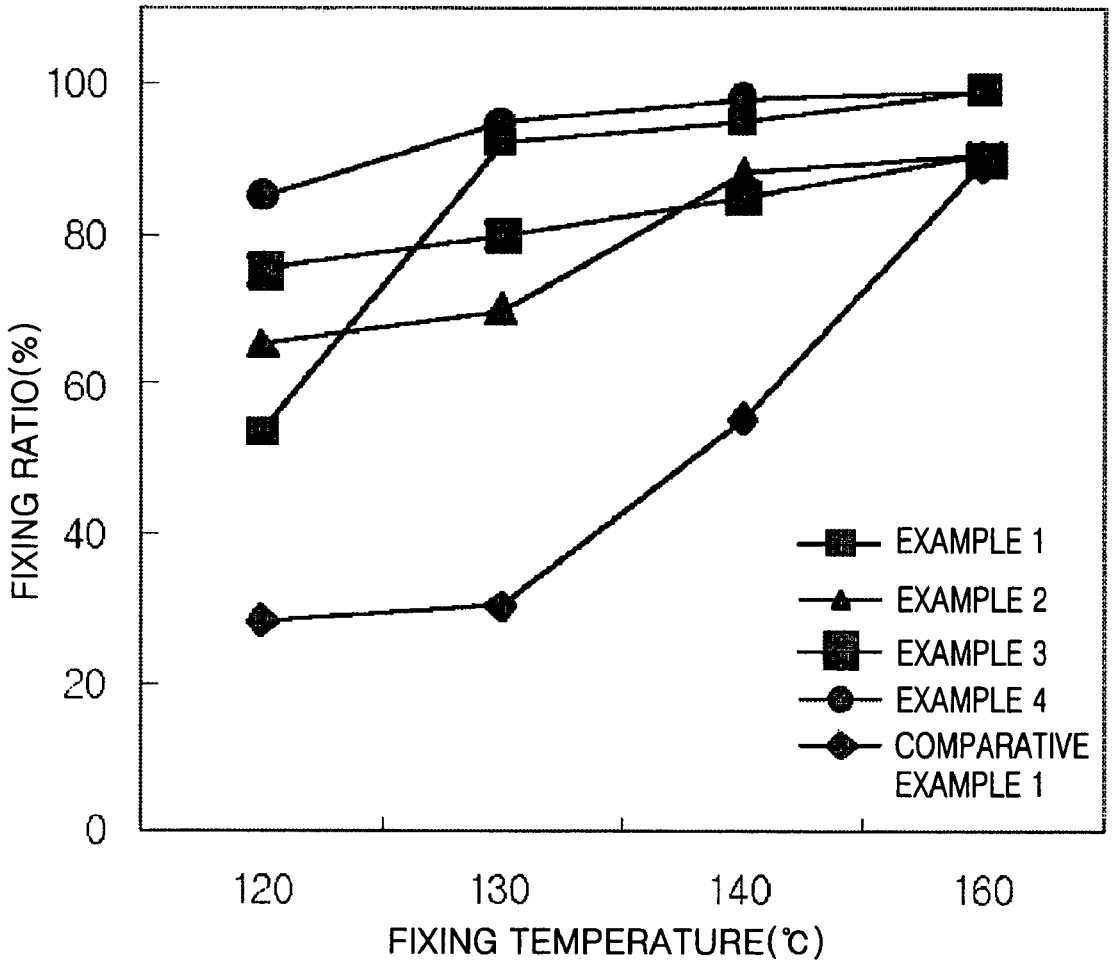
FIG. 2 shows fixing characteristics of toners according to Examples 1 through 4 of the present invention and Comparative Example 1 on 90 g/cm$^2$ weight papers.

Meanwhile, FIG. 2 shows fixing properties of the toners of Examples 1 through 4 and Comparative Example 1 on 90 g/cm$^2$ thick sheets of paper containing cotton that has drawbacks in fixing. As shown in FIG. 2, the fixing ratio of the toner of Comparative Example 1 was rapidly reduced to less than 30% at 120° C. On the other hand, the toners of Examples 1 through 4 of the present invention exhibited a relatively effective fixing property. This might result from the fact that the melting temperature of the crystalline polyester is lower than that of the styrene resin, and thus, the crystalline polyester previously molten facilitates the flowability of the styrene resin, thus enabling low temperature fixing.

Figure 3:
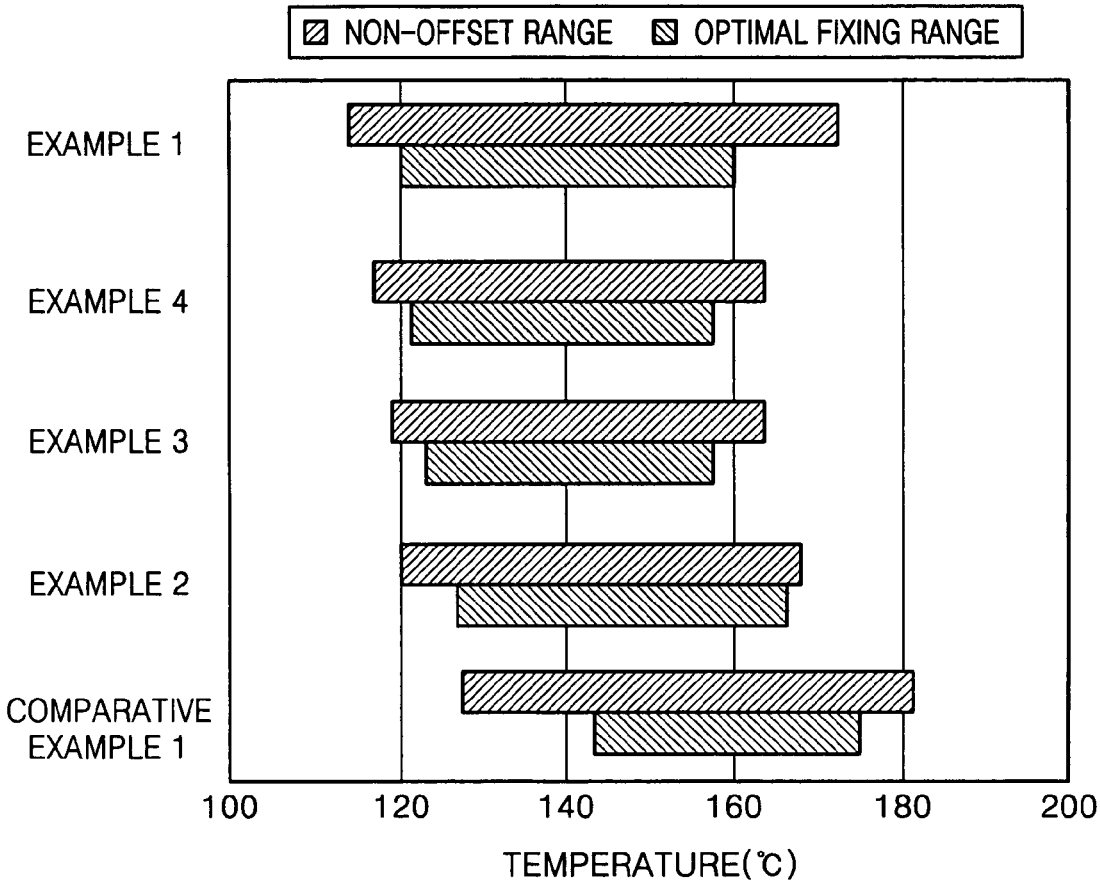
FIG. 3 shows non-offset ranges and optimal fixing ranges of toners according to Examples 1 through 4 of the present invention and Comparative Example 1.

FIG. 3 shows non-offset ranges and optimal fixing ranges of the toners according to Examples 1 through 4 of the present invention and according to Comparative Example 1. It can be seen from FIG. 3 that the toner of Comparative Example 1 has a non-offset range of approximately 130 to 180° C. The stable fixing temperature range of the toner of Comparative Example 1 is very narrow, encompassing 145 to 175° C., and the lower limit thereof is high with respect to the lower limits of the Examples. On the other hand, the fixing temperature of the toners of embodiments of the present invention ranges from approximately 120 to 160° C. Fixing is possible even at 120° C. In the case of Example 4, a stable fixing temperature ranges from about 127 to 167° C., which is a range equal to about 40° C., thus increasing the width of an available fixing temperature. The low temperature toners of embodiments of the present invention may have a low fixing temperature by 20° C. or more, relative to conventional toners. Therefore, the aging of a fixing apparatus, the curling of sheets of paper, and excess energy consumption may be overcome.

As is apparent from the above descriptions, a low temperature fixing toner of embodiments of the present invention may have a lower melting temperature than conventional toners with no change in the glass transition temperature. Therefore, the long-term storage stability and the durability of a toner can be maintained and a fixing temperature may be reduced by about 20 to 40° C., thus enabling low temperature fixing. As a result, the aging of a fixing apparatus, the curling of sheets of paper, and excess energy consumption may be overcome. Furthermore, since separate equipment is not required, an additional cost is not incurred. Also, since a structural change of a fixing apparatus is not required, an existing printer model may be used. Since a time required for fixing is short, high-speed printing is facilitated.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A toner comprising:

a binder resin comprising a main binder resin and 10 to 100 parts by weight of crystalline polyester, based on 100 parts by weight of the main binder resin, the crystalline polyester comprising diol represented by Formula 1 below:

(1)

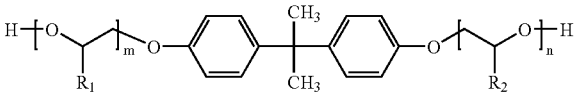

wherein, R1 and R2 are hydrogen or methyl, and n and m are 1 or 2;

2 to 25 moles of carboxylic anhydride represented by Formula 2 below, based on 100 moles of the diol of Formula 1:

(2)

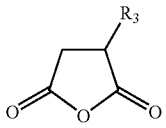

wherein, $R_3$ is an alkyl group of $C_{1-12}$;

20 to 50 moles of terephthalic acid, based on 100 moles of the diol of Formula 1; and 2 to 15 moles of trimellitic anhydride represented by Formula 3 below, based on 100 moles of the diol of Formula 1:

(3)

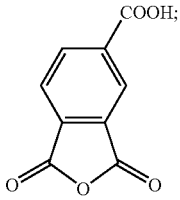

a charge control agent; and a pigment.

2. The toner of claim 1, wherein the crystalline polyester maintains a polymer chain orientation in a molten state.

3. The toner of claim 1, wherein the crystalline polyester has a weight average molecular weight of 10,000 to 100,000.

4. The toner of claim 1, wherein the crystalline polyester has a melting temperature of approximately 100 to 120° C. and a glass transition temperature of the crystalline polyester is unobservable in a differential scanning calorimetry (DSC) analysis.

5. The toner of claim 1, wherein the main binder resin comprises styrenes, acrylics, ethers, esters, epoxies, blends or copolymers thereof.

6. The toner of claim 1, wherein the main binder resin has a glass transition temperature of approximately 40 to 70° C. and a weight average molecular weight of 10,000 to 1,000,000.

7. A toner comprising:

a binder resin comprising a main binder resin and 10 to 100 carts by weight of crystalline polyester, based on 100 parts by weight of the main binder resin, the crystalline polyester comprising diol represented by Formula 1 below:

(1)

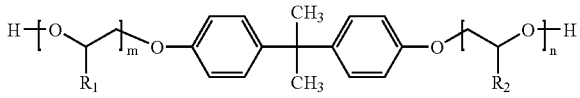

wherein, $R_1$ and $R_2$ are hydrogen or methyl, and n and m are 1 or 2;

2 to 25 moles of carboxylic anhydride represented by Formula 2 below, based on 100 moles of the diol of Formula 1:

(2)

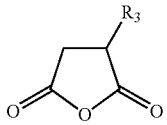

wherein, $R_3$ is an alkyl group of $C_{1-12}$;

20 to 50 moles of terephthalic acid, based on 100 moles of the diol of Formula 1; and 2 to 15 moles of trimellitic anhydride represented by Formula 3 below, based on 100 moles of the diol of Formula 1:

(3)

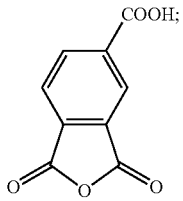

a charge control agent; and a pigment, wherein the main binder resin and the crystalline polyester are blended or form a copolymer.

* * * * *

UNITED STATES PATENT AND TRADEMARK OFFICE

CERTIFICATE OF CORRECTION

PATENT NO. : 7,115,350 B2
APPLICATION NO. : 10/785402
DATED : October 3, 2006
INVENTOR(S) : Hee-won Jung It is certified that error appears in the above-identified patent and that said Letters Patent is hereby corrected as shown below:

Column 13, Line 17 change "R1 and R2" to --$R_1$ and $R_2$--.

Column 14, Line 10 change "carts" to --parts--.

Signed and Sealed this

Twenty-fourth Day of April, 2007

JON W. DUDAS
*Director of the United States Patent and Trademark Office*